United States Patent [19]

Hasegawa et al.

[11] 4,099,297

[45] Jul. 11, 1978

[54] METHOD AND APPARATUS FOR CONTROLLING THE SLIVER-THICKNESS VARIATION IN A CARDING MACHINE

[75] Inventors: Junzo Hasegawa, Obu; Yasutaka Hayashi; Yasuhiko Suzuki, both of Nagoya; Takashi Katoh, Kariya; Takahiko Tsunekawa, Aichi; Akira Tanaka, Kariya, all of Japan

[73] Assignees: Kabushiki Kaisha Toyoda Jidoshokki Seisakusho; Kabushiki Kaisha Toyota Chuo Kenkyusho, both of Japan

[21] Appl. No.: 720,351

[22] Filed: Sep. 3, 1976

[30] Foreign Application Priority Data

Sep. 6, 1975 [JP] Japan ..... 50-108242

[51] Int. Cl.[2] ..... D01H 5/38

[52] U.S. Cl. ..... 19/240; 318/599

[58] Field of Search ..... 19/240; 318/571, 599, 318/604

[56] References Cited

U.S. PATENT DOCUMENTS

| | | | |
|---|---|---|---|
| 2,921,247 | 1/1960 | Morrison | 318/599 X |
| 3,487,458 | 12/1969 | Martens et al. | 318/599 |
| 3,523,228 | 8/1970 | Currie et al. | 318/599 |
| 3,612,975 | 10/1971 | Keefe | 318/599 |
| 3,938,223 | 2/1976 | Grice | 19/240 |

FOREIGN PATENT DOCUMENTS

| | | | |
|---|---|---|---|
| 2,401,952 | 9/1974 | Fed. Rep. of Germany | 318/599 |
| 1,538,484 | 5/1970 | Fed. Rep. of Germany | 318/599 |

*Primary Examiner*—James J. Gill

*Attorney, Agent, or Firm*—Burgess, Ryan and Wayne

[57] ABSTRACT

A method and apparatus for controlling the sliver thickness variation in a carding machine. The thickness variation of the sliver delivered from the carding machine is measured and an electrical signal corresponding to the thickness variation of the carded sliver is issued. A difference signal is created by comparing the above-mentioned electric signal, and a control pulse signal in accordance with the difference signal is intermittently created at predetermined time intervals, each of said time intervals being shorter than a time required for a length of the carded sliver which length corresponds to a long term variation of the carded slivers thickness. The supply amount of fiber tufts to the carding machine is intermittently adjusted for reducing the above-mentioned control signal toward zero by said control pulse signal at each of said time intervals.

12 Claims, 30 Drawing Figures

Fig. 1
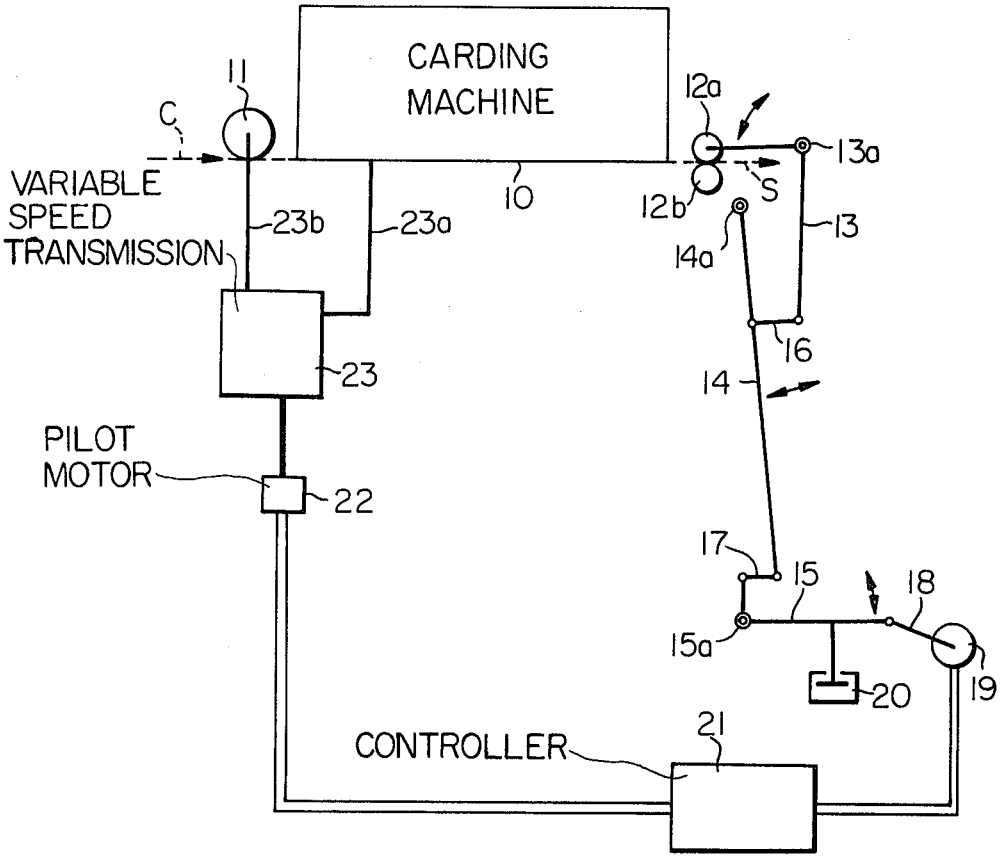
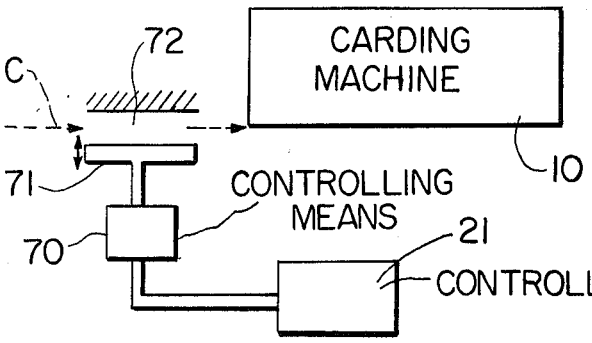
Fig. 1a

POTENTIOMETER

FILTER

LEVEL SETTING DEVICE

DIFFERENTIAL AMPLIFIER

PULSE GENERATOR

ADDER COMPARATOR

RELAY

VARIABLE SPEED TRANSMISSION DEVICE e1
e2
e1-a
e1-b
e3
e4
e5
e6
e7
e8

METHOD AND APPARATUS FOR CONTROLLING THE SLIVER-THICKNESS VARIATION IN A CARDING MACHINE

SUMMARY OF THE INVENTION

The present invention relates to a method for controlling the sliver-thickness variation in a carding machine and an apparatus for carrying out the same.

Generally, in either a lap feeding system or a tuft feeding system, the amount of fiber tufts supplied to a carding machine by means of a fiber tufts feeding machine, such as a feed roller, varies with the lapse of time. The variation of said supply amount of the fiber tufts causes the sliver to have sliver-thickness variation along its length. The sliver usually has two kinds of variations in thickness along its length when it is discharged from the carding machine, that is:

a relatively large variation in which the distance between peaks is relatively long, i.e., the time interval or period between peaks of sliver-thickness variation as it is discharged from the carding machine is relatively long, which is referred to hereinafter as long term sliver-thickness variations, and;

a relatively small variation in which the distance between peaks is relatively short, i.e., the time interval or period between peaks of the sliver as it is discharged from the carding machine is relatively short. This variation is superposed on the long term sliver-thickness variation and is referred to hereinafter as short term sliver-thickness variation. The short term sliver-thickness variation is eliminated by equalizing the thickness of the sliver through a doubling operation in the process after the carding machine. However, the long term sliver-thickness variation cannot be eliminated by said doubling operation and, as a result, the count of a yarn made from such sliver will vary along its length. Accordingly, the appearance of a woven or knitted fabric made from such yarn is poor because of the variation of the count of the yarn. Consequently, it has long been desired to realize an apparatus which can eliminate the long term sliver-thickness variation.

In order to satisfy the above mentioned desire, various kinds of apparatus for controlling the long period sliver-thickness variation have been proposed. One of the proposed apparatuses consists of:

providing a tolerance range the width of which has been predetermined with respect to a reference value of thickness of the sliver;

operating transfer switches when the thickness of the sliver becomes more or less than said tolerance range;

increasing or decreasing a speed conversion ratio of a variable speed transmission device by applying positive or negative power to a pilot motor by means of said transfer switches, which pilot motor cooperates with said variable speed transmission device, and the supply amount of the fiber tufts which is supplied to the carding machine by means of said fiber tufts feeding machine is controlled so as to keep the thickness of the sliver uniform.

Another one of the proposed apparatuses consists of:

measuring the variation of thickness of the sliver, which variation of thickness is measured by measuring the variation of air pressure in a trumpet;

converting said variation of air pressure into a variation of an electric signal;

controlling the number of rotations per unit of time of an electric motor which cooperates with the feed roller, by using an electronic control circuit including thyristors which is controlled by said electric signal, and the supply amount of the fiber tufts which is supplied to the carding machine is controlled continuously and is inversely proportional to the variation of thickness of the sliver.

However, in the former of the two above-mentioned apparatuses for controlling the long period sliver-thickness variation, it is difficult to eliminate the sliver-thickness variation with high accuracy. This is because, since the width of the tolerance range is predetermined with respect to the reference value of the thickness of a sliver and the variation of thickness is controlled so as to be maintained within said tolerance range by switching the transfer switch ON or OFF, large differences with respect to said reference value result. In the latter of the two above-mentioned apparatuses for controlling the sliver-thickness variation, the construction of the apparatus is complicated, which makes its manufacturing cost high and maintenance difficult, and furthermore, it is difficult to adjust a reference value at will.

The present invention provides an apparatus for controlling the sliver-thickness variation, which apparatus can overcome the above-mentioned shortcomings of the apparatuses of the prior art. Although the apparatus of the present invention is simple in construction and is manufactured at low cost when compared with the apparatus of the prior art, it has a greater capability of eliminating the sliver-thickness variation than that of the prior art. In the present invention, the supply amount of the fiber tufts is not controlled continuously but intermittently in accordance with the variation of the difference from a predetermined thickness of the sliver of the long term sliver-thickness variation. Accordingly, it is not necessary, in the present invention, to control the supply amount of fiber tufts continuously, so that it is inversely proportional to the variation of thickness as is necessary in the apparatus of the prior art.

It is an object of the present invention to provide a method and apparatus for controlling the long term sliver-thickness variation in a carding machine, in which apparatus, although it's construction is extremely simple and it is manufactured at low cost, the sliver-thickness variation can be eliminated with high accuracy, and further, an initial adjustment of a preset value, which adjustment is required every time the conditions of a production goal, producing speed, etc., change, can easily be completed in a short time, and in addition, it is easy to maintain the apparatus in good condition.

One of the representative embodiments of the present invention consists of:

superposing a triangle wave signal, a saw-tooth wave signal or a sine wave signal, each of which signals has a far shorter period than the long period of sliver-thickness variation during the delivery of the sliver, on an electric signal indicating the thickness of the sliver, which electric signal has been detected by a detector;

producing a control pulse signal the pulse width or the number of pulses of which is proportional to a time duration in which an amplitude of the above-mentioned superposed signal exceeds a predetermined reference level, whereby the supply amount of the fiber tufts to the carding machine is intermittently controlled by said control pulse signal so as to equalize the thickness. In another of the representative embodiments of the present invention, a control pulse signal is produced, the pulse width or the number of pulses of which is proportional to the variation in the thickness of the sliver, and the supply amount of the fiber tufts to the carding machine is intermittently controlled by said control pulse signal so as to equalize the thickness, where said control pulse is produced at an interval of time which is far shorter than a time required for a length of the carded sliver to be delivered, which length corresponds to a long term variation of the carded sliver thickness.

BRIEF EXPLANATION OF THE DRAWINGS

FIG. 1 is a sequential block diagram schematically showing the first embodiment of the present invention;

FIG. 1*a* is a block diagram illustrating another embodiment of the invention;

DETAILED EXPLANATION OF THE INVENTION

Figure 2:
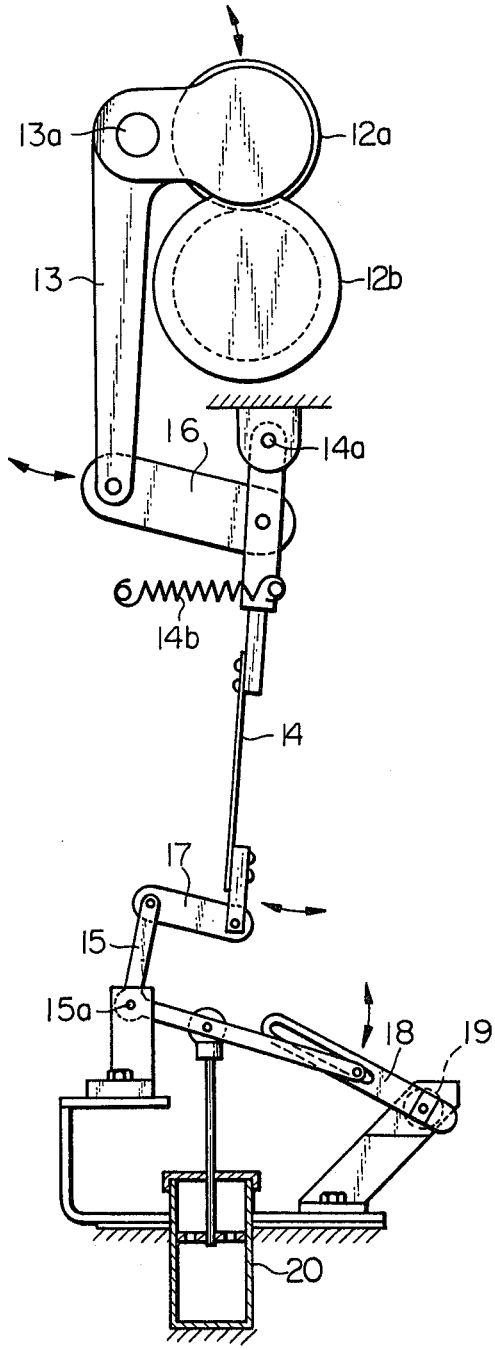
FIG. 2 is an enlarged schematic view showing in detail a mechanism of a detecting means revealed in FIG. 1.

The first embodiment of the present invention which is realized by utilizing the above-mentioned superposed triangle wave signal, will be explained by referring to FIGS. 1 to 6. In the first embodiment, referring to FIG. 1, a feed roller 11 is located near the side of a carding machine 10 for supplying fiber tufts C to the carding machine 10. The fiber tufts C are fed through the feed roller 11. A pair of measuring rollers 12*a* and 12*b* are located at the producing side of the carding machine 10. These measuring rollers measure the sliver-thickness variation which has been spun out from the carding machine. The measuring roller 12*a* can be moved upward or downward in FIG. 1 in accordance with the sliver-thickness variation. As can be seen in FIG. 1, and also in FIG. 2, levers 13, 14 and 15 are pivotally held by fulcrums 13*a*, 14*a* and 15*a*, respectively. The lever 13 is connected to the lever 14 and the lever 14 is connected to the lever 15 by way of connecting levers 16 and 17, respectively, so that the movement of the measuring roller 12*a* is sequentially expanded along the levers 13, 14 and 15. The last lever 15 is connected at its one end to a shaft (not shown) of a potentiometer 19 by way of a connecting lever 18. As a result, the expanded movement of the measuring roller 12*a*, that is the expanded sliver-thickness variation, is converted into a voltage signal through the potentiometer 19.

As seen in FIG. 2, in the above-mentioned movement expanding mechanism, a part of the lever 14 is made of a resilient substance such as a leaf spring, and one end of a return coil spring 14*b* is connected to a point on the lever 14. Further, a point on the lever 15 is connected to a buffer such as an oil damper 20. As a result, vibrating like movements of the measuring roller 12*a*, which are caused by the short term sliver-thickness variation, are for the most part absorbed by the oil damper 20. Consequently, only the movement of the roller 12*a* caused by the long term sliver-thickness variation is transferred to the potentiometer 19.

As shown in FIG. 1, a controller 21 is connected to the potentiometer 19. The controller 21 applies to a pilot motor 22 an electric signal which is proportional to the variation of a voltage signal provided to the controller 21 from the potentiometer 19 in accordance with the long term sliver-thickness variation. The pilot motor 22 changes the rotation speed of the feed roller 11 by way of a variable speed transmission device 23, when the pilot motor is rotated in a forward direction or a reverse direction under control of the controller 21. When the thickness of the sliver S increases with respect to a predetermined thickness, the speed conversion ratio between an input shaft 23*a* of the device 23 and an output shaft 23*b* of the same is changed so as to decrease the supply amount of the fiber tufts from the feed roller 11 to the carding machine 10. When the thickness of the sliver S decreases with respect to the predetermined thickness, the speed conversion ratio between the shafts 23*a*and 23*b* is changed so as to increase the supply amount of the fiber tufts from the feed roller 11 to the carding machine 10.

Figure 3:
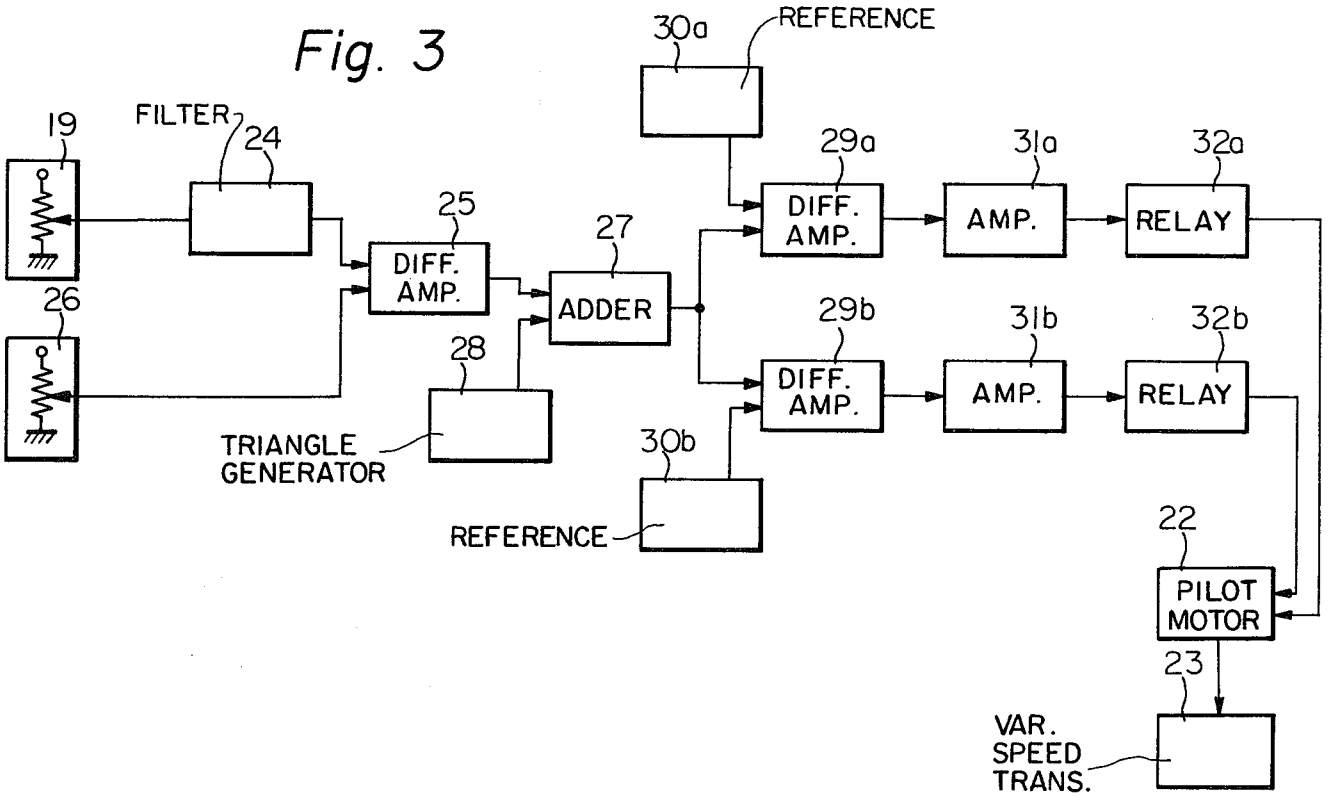
FIG. 3 is a detailed block diagram of a controller revealed in FIG. 1.
Figure 4:
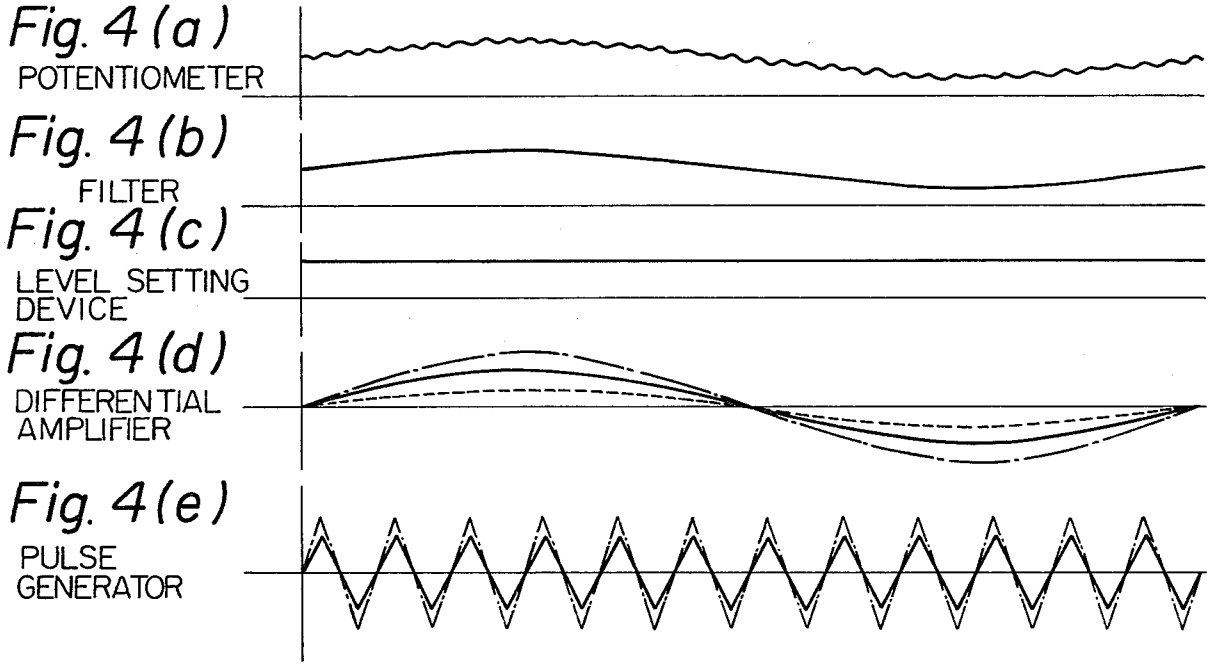
FIGS. 4(*a*) to 4(*h*), respectively, show wave forms produced from respective main blocks in FIG. 3.
Figure 4:
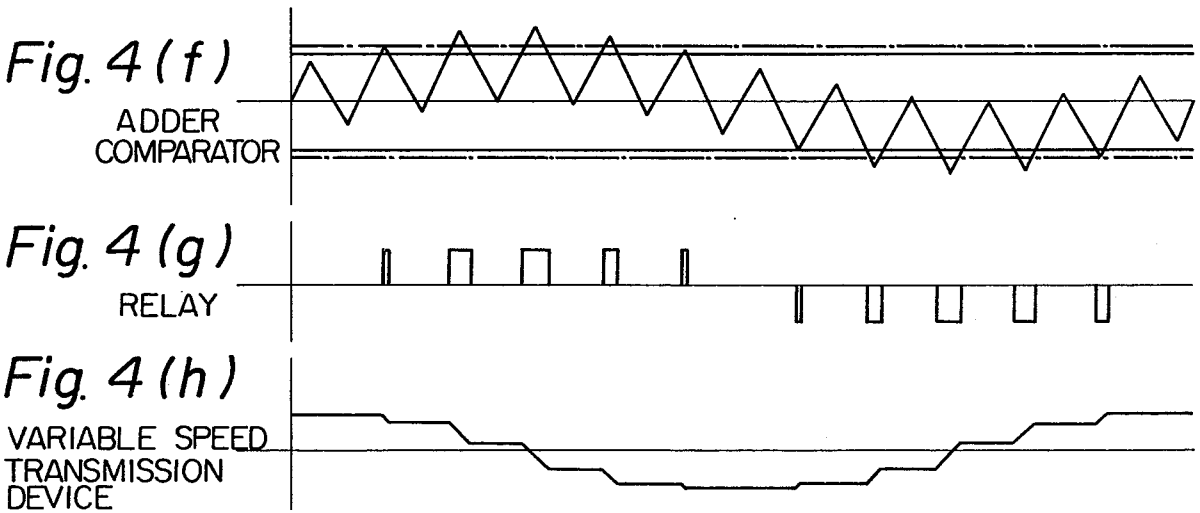

The above-mentioned controller 21 will be explained in detail with reference to FIGS. 3 and 4. As shown in FIG. 3, a filter circuit 24 is connected to said potentiometer 19. A low frequency voltage signal with a high frequency component imposed thereon is provided from the potentiometer 19. The high frequency component of this voltage signal is filtered out, as shown in FIG. 4(*a*), by means of the filter circuit 24. As a result, only a smooth, low frequency voltage signal, the relatively long period of which corresponds to the period of the long term sliver-thickness variation passes through the filter circuit 24 as shown in FIG. 4(*b*). A differential amplifier 25 is connected to the filter circuit 24 and the differential amplifier 25 receives both a voltage change signal from the filter circuit 24 and a reference voltage level from a level setting device 26. The reference voltage level is set, as shown in FIG. 4(*c*), so as to correspond to a predetermined thickness of the sliver S. The differential amplifier 25 provides a positive or negative output signal in accordance with the difference of said voltage change signal from said reference voltage level. Further, in the differential amplifier 25, said deviation, indicated by a broken line in FIG. 4(*d*), is amplified to an extent such as indicated by a chain line or a solid line in FIG. 4(*d*), which amplification can be adjusted at will. After the deviation is amplified, it is provided from the output of the amplifier 25.

An adder 27 is connected to the output of the differential amplifier 25, and is also connected to a triangle wave generator 28. The triangle wave generator 28 generates a triangle wave signal which has a far shorter period than the period of the long term sliver-thickness variation. The triangle wave signal is applied to the adder 27, together with the output signal from the differential amplifier. Further, in the triangle wave generator 28, the period and amplitude of the triangle wave signal can be adjusted at will, for example, to an extent such as shown by the curves indicated by a solid line and a chain line in FIG. 4(*e*). As a result, as is apparent from FIG. 4(*f*), the triangle wave signal from the triangle wave generator 28 is superposed, in the adder 27, on the output signal from the differential amplifier 25. Thus, when said output signal has a positive polarity the triangle wave signal is shifted upward and when said output signal has negative polarity the triangle wave signal is shifted downward.

A pair of comparators 29*a* and 29*b* are connected to the output of the adder 27. A level setting device 30*a*, which presets a predetermined positive reference voltage level, and a level setting device 30*b*, which presets a predetermined negative reference voltage, are, respectively, connected to the comparator 29*a* and the comparator 29*b*. Further, the positive reference voltage level and the negative reference voltage level can be adjusted at will in respective comparators 29*a* and 29*b*, for example, to an extent such as indicated in FIG. 4(*f*) by solid and chain lines. In the comparators 29*a* and 29*b*, the output signal from the adder 27 is compared, respectively, with the reference voltage levels from the level setting devices 30*a*and 30*b*. When the amplitude of said output signal is higher than the positive reference voltage level, the comparator 29*a* produces an output pulse signal with a pulse width which is proportional to a term where the level of said output signal is in excess of said positive reference voltage level; while, when the level of said output signal is lower than the negative reference voltage level, the comparator 29*b* produces an output pulse signal with a pulse width which is proportional to a term where the level of said output signal is in excess of said negative reference voltage level. A relay 32*a* is connected to the output of the comparator 29*a* through an amplifier 31*a*, and the pilot motor 22 is rotated in a forward direction by electric power applied through the relay 32*a*. A relay 32*b* is connected to the output of the comparator 29*b* through an amplifier 31*b*, and the pilot motor 22 is rotated in a reverse direction by electric power applied through the relay 32*b*. When the thickness of the sliver S is thicker than the predetermined thickness of the sliver S, that is when a so-called positive difference occurs, the comparator 29*a* produces an output pulse signal. After such an output pulse signal is amplified in the amplifier 31*a*, the amplified output pulse signal is applied to the relay 32*a*, as shown in FIG. 4(*g*), and the relay 32*a* is energized intermittently in accordance with the pulse width of said output pulse signal from the comparator 29*a*. On the other hand, when the thickness of the sliver S is thinner than said predetermined thickness of the sliver, that is when a so-called negative deviation occurs, the comparator 29*b* produces the output pulse signal. After such an output pulse signal is amplified in the amplifier 31*b*, the amplified output pulse signal is applied to the relay 32*b* and the relay 32*b* is energized intermittently in accordance with the pulse width of said output pulse signal from the comparator 29*b*. Therefore, when the relay 32*a* is energized, the pilot motor 22 is rotated intermittently in a forward direction and, accordingly, the speed conversion ratio of the variable speed transmission device 23 is decreased step-wisely from a predetermined value of the ratio toward a low speed side such as shown in FIG. 4(*h*). On the other hand, when the relay 32*b* is energized, the pilot motor 22 is rotated intermittently in a reverse direction and, accordingly, the speed conversion ratio of the variable speed transmission device 23 is increased step-wisely from a predetermined value of the ratio toward a high speed side such as also shown in FIG. 4(*h*).

Figure 5A:
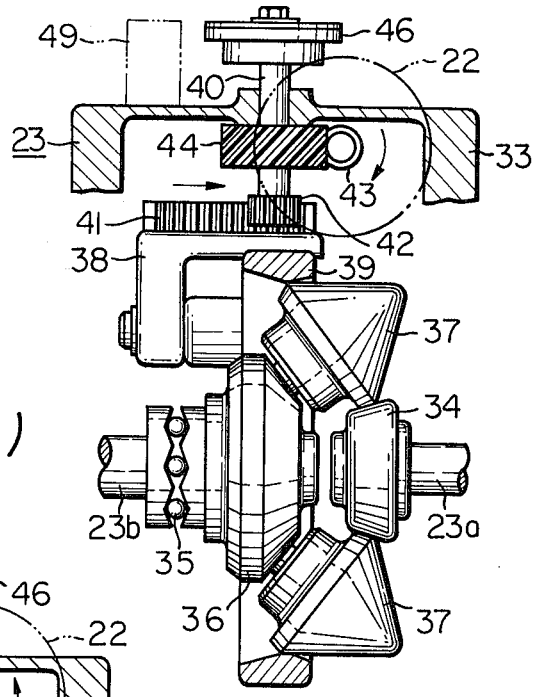
FIGS. 5(*a*) and 5(*b*) show longitudinal sectional views, partially cut away, of a variable speed transmission device operating in, respectively, its high speed side and its low speed side.
Figure 5B:
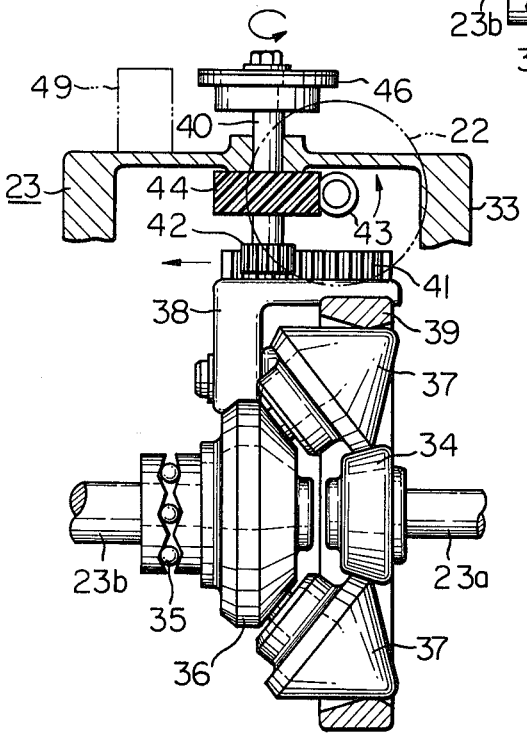
Figure 6:
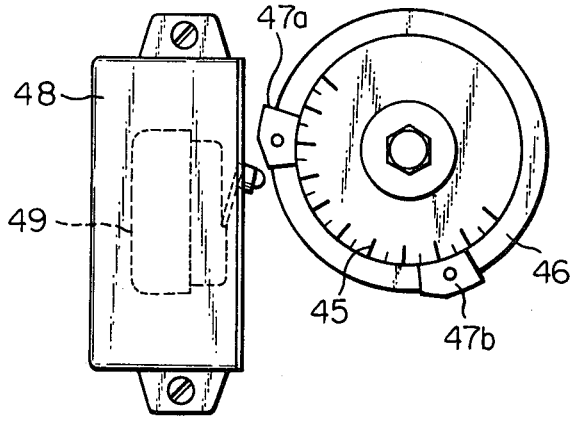
FIG. 6 is an enlarged plan view of a rotating disk and a limit switch, both shown in FIG. 5(*a*)

The above-mentioned variable speed transmission device 23 will be explained in detail by referring to FIGS. 5 and 6. A sun cone 34 is fixed to one end of an input shaft 23*a* which is rotatably supported (not shown) by a frame 33. A planet cone holder 36 is fixed to one end of an output shaft 23*b* through a automatic pressure control cam 35, which shaft 23*b* is rotatably supported (not shown) by the frame 33 and force the input shaft 23*a*. A plurality of planet cones 37 are rotatably mounted on the planet cone holder 36, and a truncated cone-shaped outer surface of each of the planet cones 37 is pressed against an outer surface of the sun cone 34. Further, in the frame 33, a ring 39 is held by means of a sliding member 38 in such a manner that the ring 39 is movable in a direction coaxial with the output shaft 23*b*, and the cone-shaped inner surface of the ring 39 presses against each truncated cone-shaped outer surface of the planet cones 37. In the above arrangement, when the input shaft 23*a* is rotated, each of the planet cones 37 revolves round the sun cone 34 and, at the same time, rotates on its axis so that the revolutions of the planet cones 37 are transferred to the output shaft 23*b* by way of the automatic pressure control cam 35. During the time said revolutions are being transferred to the shaft 23*b*, the ring 39 is shifted toward the left in FIG. 5, as shown in FIG. 5(*a*). When the cone-shaped outer surface of larger diameter of each of the planet cones 37 is pressed against the inner surface of the left shifted ring 39, the effective contacting diameter ratio of each of the cones 37 with respect to the ring 39 increases. Accordingly, the speed conversion ratio of the output shaft 23*b* with respect to the input shaft 23*a* increases and the output shaft 23*b* is rotated at high speed. On the other hand, as seen from FIG. 5(*b*), when the ring 39 is shifted toward the right in FIG. 5, and the cone-shaped outer surface of smaller diameter of each of the planet cones 37 is pressed against the inner surface of the ring 39, the effective contacting diameter ratio of each of the cones 37 with respect to the ring 39 decreases. Accordingly, the speed conversion ratio of the output shaft 23*b* with respect to the input shaft 23*a* decreases and the output shaft 23*b* is rotated at low speed.

A pinion 42 is fixed to a bottom end of an adjusting rod 40, where the adjusting rod 40 is rotatably supported by the frame 33 above the sliding member 38. The pinion 42 engages with a rack 41 which is projected from the sliding member 38. Further a driven gear 44 is fixed to a middle part of the adjusting rod 40 and engages with a drive gear 43 connected to a driving shaft of the pilot motor 22. Thus, when the thickness of the sliver S increases and, accordingly, the pilot motor 22 is rotated in forward direction, as indicated by a curved arrow in FIG. 5(*a*), the adjusting rod 40 is rotated in a clock-wise direction as indicated by a semi-circular shaped arrow in FIG. 5(*a*), and, at the same time, the sliding member 38 is shifted toward the right in FIG. 5 by way of the pinion 42 and the rack 41. As a result, as shown in FIG. 5(*b*), the ring 39 is shifted to such a position that the output shaft 23*b* is rotated at low speed. On the other hand, when the thickness of the sliver S decreases and, accordingly, the pilot motor 22 is rotated in a reverse direction, as indicated by a curved arrow in FIG. 5(*b*), the adjusting rod 40 is rotated in a counter clockwise direction as indicated by semi-circular shaped arrow in FIG. 5(*b*), and, at the same time, the sliding member 38 is shifted toward the left in FIG. 5 by way of the pinion 42 and the rack 41. As a result, as shown in FIG. 5(*a*), the ring 39 is shifted to such a position that the output shaft 23*b* is rotated at high speed.

A rotating disk 46 provided with a scale 45 (FIG. 6) is attached to a top end of the adjusting rod 40 which extends outside the frame 33. As seen from FIG. 6, a dog 47*a* is adjustably fixed to the rotating disk 46 and faces the scale 45. The dog 47*a* defines a limit of the high speed of the variable speed transmission device 23. A dog 47*b* is also adjustably fixed to the rotating disk 46 and faces the scale 45 at a position which is a predetermined distance from the dog 47*a*. The dog 47*b* defines a limit of the low speed of the variable speed transmission device 23. As shown in FIG. 5 and FIG. 6, a limit switch 49 is mounted on the frame 33 and faces the dog 47*a* or 47*b*. The limit switch 49 is kept in a hermetically sealed condition by means of a cover 48. When the thickness of the sliver S is abnormally decreased due to the occurrence of a partial breakage of web in the carding machine during the producing process, the arrangement of members in the variable speed transmission device 23 is changed to an arrangement, as shown FIGS. 5(*a*) and 6. In this changed arrangement the device 23 operates in its high speed side far higher than the limit of its high speed side. And when the arrangement of members is changed to an arrangement in which the device 23 operates in its high speed side far higher than said limit, the rotating disk 46 is rotated in a counter clockwise direction in FIG. 6 with large rotating angle. Then, the limit switch 49 is actuated by the dog 47*a* and the carding machine stops being driven. On the other hand, when the thickness of the sliver S is abnormally increased by a large increase in the supply amount of the fiber tufts, due to an occurrence of a trouble in, for example, a chute feeding device located at the fiber's upstream side of said feed roller 11, the arrangement of members in the variable speed transmission device 23 is changed to an arrangement, as shown in FIG. 5(*b*). In this changed arrangement the device 23 operates in its low speed side far lower than the limit of low speed side. And when the arrangement of members is changed to an arrangement in which the device 23 operates in the low speed side far lower than said limit, the rotating disk 46 is rotated in a clockwise direction in FIG. 6 with large rotating angle. Then, the limit switch 49 is actuated by the dog 47*b* and the carding machine stops being driven.

In FIG. 1, when the carding machine 10 starts being driven, the fiber tufts C fed by the feed roller 11 is formed into a thin film of web in the carding machine 10. Thereafter, the thin film of web is formed into the sliver S, through a raking operation of the web by using a trumpet. The sliver S is stored in cans after it is produced. During the time the carding machine is being driven, when the thickness of the sliver S varies due to the variation of the supply amount of the fiber tufts C, the sliver-thickness variation is measured by the upward or downward movement of the measuring roller 12*a*. The upward or downward movement of the measuring roller 12*a* is sequentially expanded along the levers 13, 14 and 15, and the expanded movement of the roller 12*a* actuates the shaft of the potentiometer 19. In the potentiometer 19, as shown in FIG. 4(*a*), the sliver-thickness variation is converted into a voltage signal. The variation of the voltage signal from the potentiometer is flattened by the filter circuit 24 as shown in FIG. 4(*b*) and, thereafter, said flattened variation voltage signal is applied to the differential amplifier 25. In the differential amplifier 25, the voltage difference between the flattened voltage signal from the filter circuit 24 and the reference voltage level, shown in FIG. 4(*c*), from the level setting device 26, is amplified. This amplified positive or negative voltage difference, which corresponds to the sliver-thickness variation, as shown in FIG. 4(*d*), is provided as a signal from the output amplifier 25.

The triangle wave signal, shown in FIG. 4(*e*), from the triangle wave generator 28 is superimposed, in the adder 27, on the output signal from the amplifier 25. When said output signal has a positive polarity the triangle wave signal is shifted upward, while, when said output signal has negative polarity the triangle wave signal is shifted downward. Further, as shown in FIG. 4(*f*), the output signal from the adder 27 is compared, respectively, with the reference voltage levels from the respective level setting devices 30*a* and 30*b*. When the amplitude of said output signal is higher than the positive reference voltage level, the comparator 29*a* produces an output pulse signal with a pulse width which is proportional to a term where the level of said output signal is in excess of said positive reference voltage level. On the other hand, when the amplitude of said output signal is lower than the negative reference voltage level, the comparator 29*b* produces an output pulse signal with a pulse width which is proportional to a term where the level of said output signal is in excess of said negative reference voltage level.

When an output pulse signal is provided from the comparator 29*a* due to an increase of thickness of the sliver S, after amplifying the output pulse signal in the amplifier 31*a*, as shown in FIG. 4(*g*), the signal is applied to the relay 32*a*. As a result the relay 32*a* is energized in accordance with the pulse width of said output pulse signal and the pilot motor 22 is rotated in the forward direction. When an output pulse signal is provided from the comparator 29*b* due to a decrease of thickness of the sliver S, after amplifying the output pulse signal in the amplifier 31*b*, the signal is applied to the relay 32*b*. As a result, the relay 32*b* is energized in accordance with the pulse width of said output pulse signal and the pilot motor 22 is rotated in the reverse direction.

As mentioned above, when the pilot motor 22 is rotated intermittently in the reverse direction in accordance with an increase in the thickness of the sliver S, the rotation of the shaft of the pilot motor 22 is transferred to the sliding member 38 by way of the drive gear 43, the driven gear 44, the adjusting rod 40, the pinion 42 and the rack 41. This results in the ring 39 being shifted from such a position as shown in FIG. 5(*a*) to such a position as shown in FIG. 5(*b*). In the latter position of the ring 39, the variable speed transmission device 23 operates in its low speed side. Accordingly, the speed conversion ratio of the output shaft 23*b* with respect to the input shaft 23*a* is shifted from a predetermined value to the low speed side as shown in FIG. 4(*h*), and the rotation speed of the feed roller 11 is decreased. As a result, the supply amount of the fiber tufts to the carding machine 10 is decreased as the thickness of the sliver S increases. On the other hand, when the pilot motor 22 is rotated intermittently in the forward direction in accordance with a decrease in the thickness of the sliver S, the rotation of the shaft of the pilot motor 22 is transferred to the sliding member 38 by way of the drive gear 43, the driven gear 44, the adjusting rod 40, the pinion 42 and the rack 41. This results in the ring 39 being shifted from such a position as shown in FIGS. 5(*a,b*) to such a position as shown in FIG. 5(*a*). In the latter position of the ring 39, the variable speed transmission device 23 operates in its high speed side. Accordingly, the speed conversion ratio of the output shaft 23*b* with respect to the input shaft 23*a* is shifted from a predetermined value to the high speed side as shown in FIG. 4(*h*), and the rotation speed of the feed roller 11 is increased. As a result, the supply amount of the fiber tufts to the carding machine 10 is increased as the thickness of the sliver S decreases. Thus, the thickness of the sliver S delivered from the carding machine 10, is maintained at a predetermined constant thickness and, accordingly, high quality yarn can be obtained.

If while the carding machine 10 is being driven a partial breakage of web occurs therein, the thickness of the sliver S is abnormally decreased. In this case, the ring 39 of the variable speed transmission device 23 is shifted, under control of the controller 21, to a position far apart from the position shown in FIGS. 5(*a*) and 6. In FIGS. 5(*a*) and 6, said ring 39 is located in a position where the device 23 operates in its high speed side. When the ring 39 is shifted and passes through a position where the device 23 operates in excess of the limit of its high speed side, the limit switch 49 is actuated by the dog 47*a* mounted on the periphery of the rotating disk 46, and the carding machine stops being driven. Consequently, the carding machine can not continue being driven without repairing the partial breakage of web and, accordingly, loss fiber tufts and a decrease in the quality of yarn is prevented. On the other hand, if while the carding machine 10 is being driven trouble occurs in, for example, a chute feeding device located at fiber's upstream side of the feed roller 11, the thickness of the sliver S is abnormally increased. In this case, the ring 39 of the variable speed transmission device 23 is shifted, under control of the controller 21, to a position far apart from the position shown in FIGS. 5(*a*) and 6. In FIGS. 5(*a*) and 6, said ring 39 is located in a position where the device 23 operates in its low speed side. When the ring 39 is shifted and passes through a position where the device 23 operates in excess of the limit of its low speed side, the limit switch 49 is actuated by the dog 47*b* mounted on the periphery of the rotating disk 46, and the carding machine stops being driven. Consequently, the carding machine can not continue being driven without reparing said trouble in the chute feeding device and, accordingly, a decrease in the quality of yarn is prevented.

When it is required to change a preset value of the thickness of the sliver in the controller 21, due to a change of producing speed, a production goal, etc., the change of said preset value in the controller 21 can easily and quickly be completed by adjusting at least one of the following: the amplification degree of the differential amplifier 25; the period or magnitude of the triangle wave signal provided from the triangle wave generator 28; the positive reference voltage level of the level setting device 30*a*, and; the negative reference voltage level of the level setting device 30*b*. Further, when it is required to change the limits of high speed and/or low speed in the device 23 in accordance with the condition of the web, the change of said limits can easily and quickly be completed by adjusting the positions of dogs 47*a* and/or 47*b* on the periphery of the rotating disk 46 by referring to the scale 45.

The second embodiment of the present invention will now be explained by referring to FIGS. 7 and 8. The second embodiment of the apparatus for controlling the sliver-thickness variation is similar to the previously described first embodiment from the point of view that: firstly, the thickness of a sliver delivered from a cading machine is detected and indicated as an electric signal by a potentiometer by utilizing a measuring roller, and; secondly, said electric signal indicating the thickness of the sliver is compared, in a differential amplifier, with a reference voltage level corresponding to a predetermined value of the thickness of the sliver and, thereby, a voltage difference signal between said electric signal and the reference voltage level is provided for controlling the sliver. However, the control circuit of the second embodiment is different from that of the first embodiment. This control circuit is provided for controlling the speed conversion ratio of a variable speed transmission device by applying adequate electric power to a pilot motor. That is, in the second embodiment, said control circuit is constructed based on a so-called pulse width modulation method, while said control circuit of the first embodiment is constructed so as to be able to utilize the previously mentioned superposed triangle wave signal.

Figure 7:
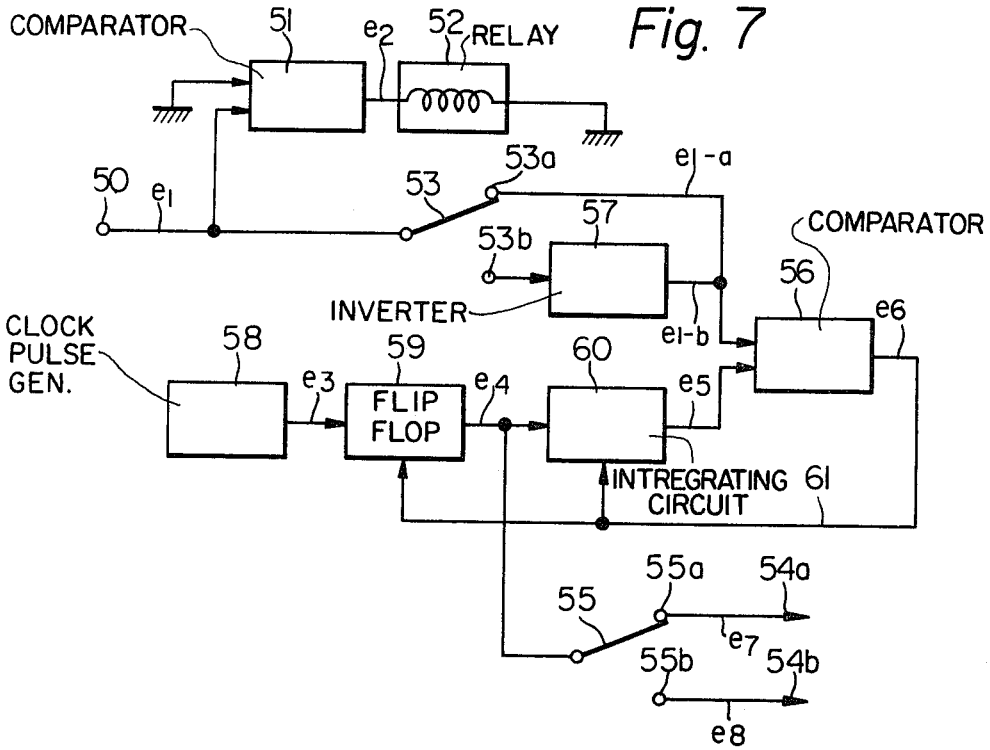
FIG. 7 is a block diagram of the second embodiment according to the present invention.

In FIG. 7, an input terminal 50 is connected to a comparator 51 which distinguishes whether a difference signal *e*1, which is produced in accordance with the sliver-thickness variation has positive or negative polarity. As shown in FIG. 8(*a*) and FIG. 8(*b*), when the polarity of signal *e*1 is positive, the output signal *e*2 from the comparator 51 becomes an "0" level signal. On the other hand, when a polarity of the signal *e*1 is negative, the output signal *e*2 becomes a "1" level signal. A relay 52 is connected to the output of the comparator 51 and is energized when the output signal *e*2 becomes a "1" level signal. When the relay 52 is energized, a switching over element 53, connected to the input terminal 50, of the relay 52 transfers its contact from a contact point 53*a* to a contact point 53*b*, and a switching over element 55 of the relay 52 transfers its contact from a contact point 55*a* to a contact point 55*b*. The contact points 55*a* and 55*b* are, respectively, connected to output terminals 54*a* and 54*b*. Electric power provided through the output terminal 54*a* causes the pilot motor to operate the variable speed transmission device in its low speed side, while electric power provided through the output terminal 54*b* causes the pilot motor to operate the variable speed transmission device in its high speed side. A first input of a comparator 56 is connected to the contact point 53*a* of the switching over element 53 and an inverter circuit 57 is inserted between the contact point 53*b* of the switching over element 53 and the first input of the comparator 56. When the polarity of the difference signal *e*1 is positive, the contact of the element 53 is transferred to the contact point 53*a* and a positive difference signal *e*1 is provided as a positive input signal *e*1-*a*, as shown in FIG. 8(*c*), from the contact point 53*a*. On the other hand, when a polarity of the difference signal *e*1 is negative, the contact of the switching over element 53 is transferred to the contact point 53*b* and a negative difference signal *e*1 is provided as a positive input signal *e*1-*b*, as shown in FIG. 8(*c*), from the inverter circuit 57. Both of the input signals *e*1-*a* and *e*1-*b* are applied to the first input of the comparator 56.

In an electric path connected to a second input of the comparator 56, a clock pulse generator 58 is provided. As shown in FIG. 8(*d*), the clock pulse generator 58 produces a pulse signal *e*3, the period of which is constant and far shorter than a time required for a length of the carded sliver to be delivered, which length corresponds to a long term variation of the carded sliver thickness. A flip-flop circuit 59 is connected to the clock pulse generator 58, and the flip-flop circuit 59 produces an output pulse signal *e*4 which changes to a "1" level signal when the pulse signal *e*3 occurs. An integrating circuit 60 is connected to the output of the flip-flop circuit 59 and produces an integrated output signal *e*5, as shown in FIG. 8(*c*), based on the output pulse signal *e*4. The integrated output signal *e*5 is applied to a second input of the comparator 56. Since the input signal of the integrating circuit 60, that is the output pulse signal *e*4, always has a constant amplitude of a "1" level signal, the integrated output signal *e*5 from the integrating circuit 60 always increases with a constant slope. A feedback path is inserted between the output of the comparator 56 and both the flip-flop circuit 59 and the integrating circuit 60. The output of the integrating circuit 60 is also connected to the switching over element 55.

Figures 8A, 8B, 8C, 8D, 8E, 8F, 8G, 8H:
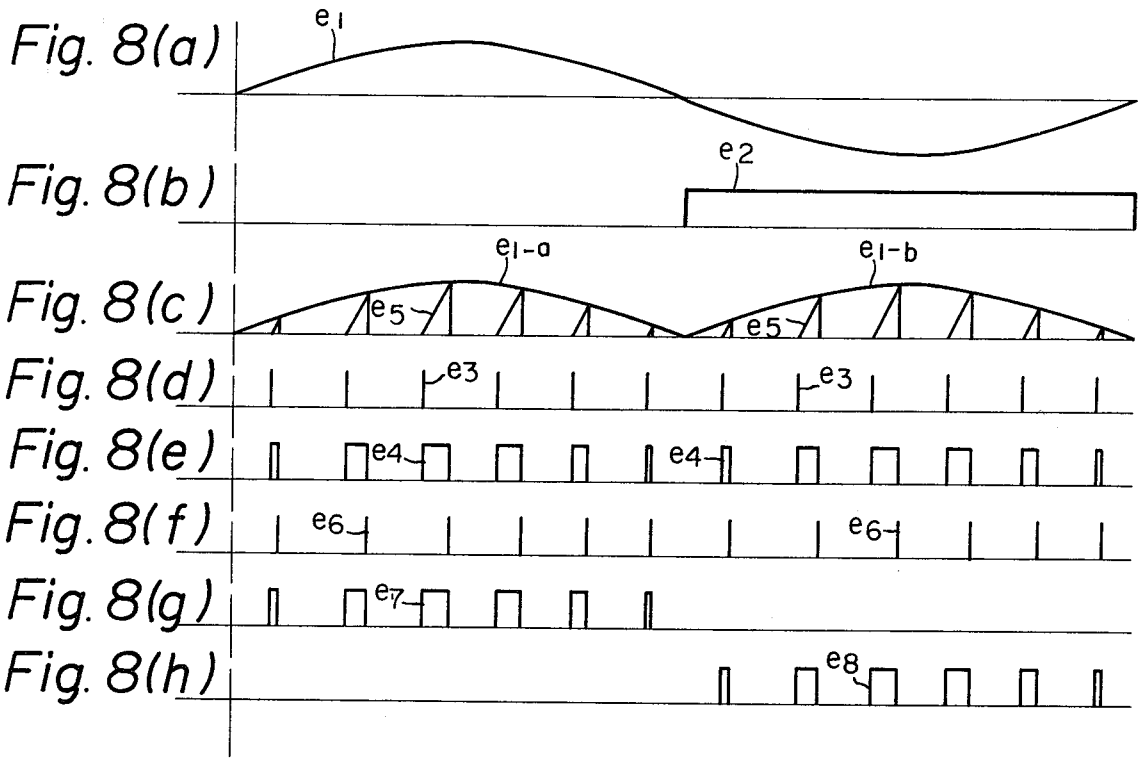
FIGS. 8(*a*) to 8(*h*), respectively, show wave forms produced from respective main blocks in FIG. 7.

In the comparator 56, the integrated output signal *e*5 from the integrating circuit 60 is compared with the input signal *e*1-*a* or *e*1-*b*, which is produced in accordance with the difference signal *e*1 and provided from the input terminal 50. When the amplitude of the input signal *e*1-*a* is higher than the amplitude of the signal *e*5, or when the amplitude of the input signal *e*1-*b* is higher than the amplitude of the signal *e*5, the level of the output signal *e*6 from the comparator 56 changes from "0" to "1", as shown in FIG. 8(*f*). By utilizing the change from "0" level to "1" level of the output signal *e*6, both the flip-flop circuit 59 and the integrating circuit 60 are reset, and the signal *e*6 is applied to the circuits 59 and 60 through the feedback path 61. As a result, both the signal *e*4 from the circuit 59 and the singal e5 from the circuit 60 return to "0" level signals. Soon after this, the output signal *e*6 from the comparator 56 becomes a "0" level signal and, accordingly, the pulse width of the signal e6 becomes extremely short, as shown in FIG. 8(f). Further, the signal e6 and the signals *e*4 and *e*6 are kept "0" level signals until the time the next pulse signal *e*3 is provided from the clock pulse generator 58.

When said next pulse signal *e*3 is provided from the clock pulse generator 58, the same operation as mentioned above starts. When the level of the input signal *e*1-*a* or e1-b to the comparator 56 goes higher in accordance with the increasing difference signal e1 due to the increase of thickness of the sliver, a term goes longer, which term is defined by a time from when the pulse signal *e*3 is produced to a time when the output signal e6 is produced. Then, the output pulse signal *e*4 is produced from the flip-flop circuit 59 at a period far shorter than a time required for a length of carded sliver to be delivered, which length corresponds to a long term variation of the carded sliver thickness. The pulse width of the output pulse signal *e*4 is proportional to the magnitude of the input signal *e*1-*a* or *e*1-*b* applied to the comparator 56. Consequently, if the difference signal *e*1, corresponding to the sliver-thickness variation, is positive and, accordingly, the contacts of the switches 53 and 55 are, respectively, connected to the contact points 53*a* and 55*a*, the output signal *e*4 from the flip-flop circuit 59 is applied, as a signal *e*7 shown in FIG. 8(g), to the output terminal 54*a*. *The signal e*7, which varies in accordance with the pulse width of the output signal *e*4, from the terminal 54*a* controls the pilot motor so as to cause the variable speed transmission device to operate in its low speed side. This control process is similar to the control process mentioned in the explanation of the first embodiment. On the other hand, if the difference signal *e*2, due to the sliver-thickness variation, is negative and, accordingly, contacts of the switching over elements 53 and 55 are, respectively, connected to the contact points 53*b* and 55*b*, the output signal *e*4 from the flip-flop circuit 59 is applied, as a signal *e*8 shown in FIG. 8(g), to the output terminal 54*b*. The signal *e*8, which varies in accordance with the pulse width of the output signal *e*4, from the terminal 54*b* controls the pilot motor so as to cause the variable speed transmission device to operate in the high speed side. Thus, the supply amount of the fiber tufts to the carding machine is intermittently controlled in accordance with the sliver-thickness variation, the thickness of the sliver is maintained at a predetermined constant thickness and, accordingly, high quality yarn can be obtained.

When it is required to change, in the control apparatus of the second embodiment, a preset value of the thickness of the sliver due to a change of producing speed, a production goal, etc., the change of the preset value in said control apparatus can easily and quickly be completed by adjusting at least one of the following: the amplification degree of the deviation signal el in the differential amplifier; the period of the clock pulse signal in the clock pulse generator 58; the magnitude of the output signal *e*4 in the flip-flop circuit 59, and; the integration constant of the integrating circuit 60.

The third embodiment of the present invention will now be explained by referring to FIGS. 9 and 10. The third embodiment of the apparatus for controlling the sliver-thickness variation is similar to the previously mentioned first and second embodiments from the point of view that: firstly, the thickness of a sliver delivered from a carding machine is detected and indicated as an electric signal by a potentiometer by utilizing a measuring roller, and; secondly, said electric signal indicating the thickness of the sliver S is compared, in a differential amplifier, with a reference voltage lever corresponding to a predetermined value of the thickness of the sliver S and, thereby, a voltage difference signal between said electric signal and the reference voltage lever is provided for controlling the sliver S. However, the control circuit of the third embodiment is different from those of the first and second embodiments. This control circuit is provided for controlling the speed conversion ratio of a variable speed transmission device by applying adequate electric power to a pilot motor. That is, in the third embodiment, said control circuit is constructed based on a so-called pulse number controlling method, while said control circuit of the first embodiment is constructed so as to be able to utilize the previously mentioned superposed triangle wave signal and said control circuit of the second embodiment is constructed based on a so-called pulse width modulation method.

Figure 9:
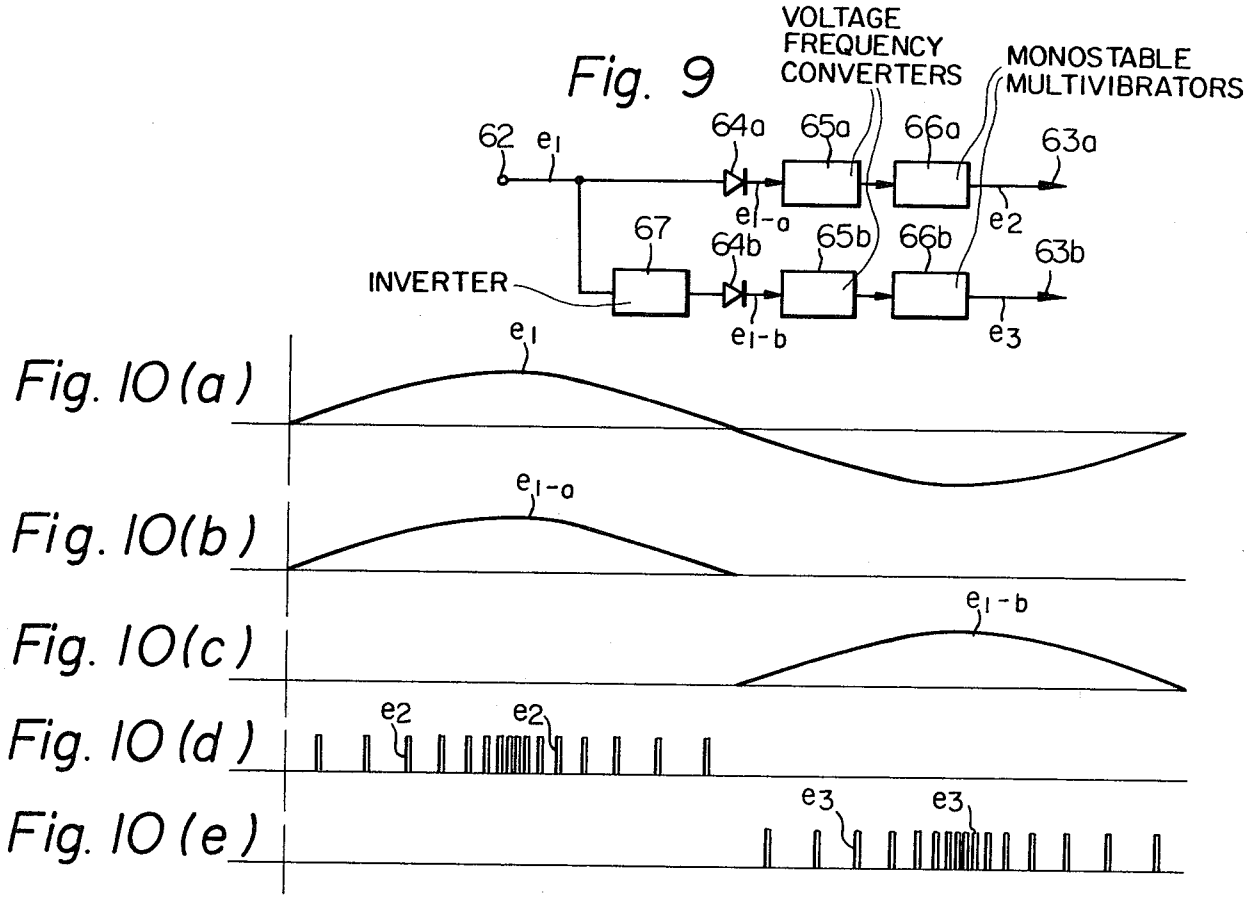
FIG. 9 is a block diagram of a controller used in the third embodiment according to the present invention, FIGS. 10(*a*) to 10(*e*), respectively, show wave forms produced from respective main blocks in FIG. 9.

In FIG. 9, a difference signal *e*1 is provided from an input terminal 62, and both a first control circuit and a second control circuit, arranged in parallel with the first control circuit, are connected to the input terminal 62. The first control circuit produces a first output signal from the first output terminal 63a which drives the pilot motor, in accordance with the positive difference, so as to cause the variable speed transmission device to operate in its low speed side. On the other hand, the second control circuit produces a second output signal from the second output terminal which drives the pilot motor, in accordance with the negative difference, so as to set the variable speed transmission device into a high speed side. The first control circuit comprises- a diode 64*a*, through which only a positive difference signal el can pass; a voltage/frequency converter circuit 65*a*, which converts an input voltage signal into an output frequency signal, and; a monostable multivibrator circuit 66a which produces a number of constant pulse width pulses, the number of which is proportional to the magnitude of the difference signal el. On the other hand, the second control circuit comprises an inverter circuit 67 which inverts a negative difference signal el to a positive difference signal, a diode 64*b*, a voltage/frequency converter circuit 65*b* and a monostable multivibrator circuit 66*b*.

When a positive difference signal el is provided from the input terminal 62, the positive difference signal *e*1 is provided, as a difference signal *e*1-*a*, from the diode 64*a* as shown in FIGS. 10(a) and (b). The voltage/frequency converter circuit 65*a* produces a frequency signal, the frequency of which is proportional to the magnitude of the difference signal *e*1-*a*. The monostable multivibrator circuit 66*a* produces a number of constant pulse width pulses *e*2, the number of which is proportional to the frequency of said frequency signal as shown in FIG. 10(d). The pulses *e*2 are applied, through the output terminal 63*a*, to the pilot motor. The pilot motor is driven at a period far shorter than the period of the long period sliver-thickness variation, in accordance with the number of pulses *e*2, so as to cause the variable speed transmission device to operate in its low speed side. In the case, just described, the negative difference signal *e*1 cannot be provided from the output terminal 63*b*, because, the positive difference signal *e*1 is inverted into a negative signal by way of the inverter circuit 67, which negative signal cannot pass through the diode 64*b*.

On the other hand, when a negative difference signal e1 is provided from the input terminal 62, the negative difference signal *e*1 is provided as a positive deviation signal *e*1-*b*, from the diode 64*a*, by means of the inverter circuit 67, as shown in FIGS. 10(a) and 10(c). The voltage/frequency converter circuit 65*b*, produces a frequency signal, the frequency of which is proportional to the magnitude of the difference signal *e*1-*b*. The monostable multivibrator circuit 66*b* produces a number of constant pulse width pulses *e*3, the number of which is proportional to the frequency of said frequency signal as shown in FIG. 10(e). The pulses *e*3 are applied, through the output terminal 63*b*, to the pilot motor. The pilot motor is driven with a far shorter period than a time required for a length of the carded sliver to be delivered, which length corresponds to a long time variation of the carded sliver thickness, in accordance with the number of pulses e3, so as to cause the variable speed transmission device to operate in the high speed side. In the case just described, the negative difference signal *e*1 cannot be provided from the output terminal 63*a*, because, a negative signal cannot pass through the diode 64*a*. Thus, the supply amount of the fiber tufts to the carding machine is intermittently controlled in accordance with the sliver-thickness variation, the thickness of the sliver S is maintained at a predetermined constant thickness and, accordingly, high quality yarn can be obtained.

When it is required to change, in the control apparatus of the third embodiment, a preset value of the thickness of the sliver due to a change of producing speed, production goal, etc., the change of the preset value in said control apparatus can easily and quickly be completed by adjusting at least one of the following: the amplification degree of the difference signal *e*1 in the differential amplifier; the convertion factor in the voltage/frequency converter circuits 65*a* and/or 65*b*, and; the pulse widths of the output pulses from the monostable multivibrator circuits 66*a* and/or 66*b*. In this adjustment, it should be noted that the pulse widths of the output pulses *e*2 and/or *e*3 should be selected to be longer than the response time of the pilot motor. Further, the periods of the output pulses *e*2 and/or *e*3 should be far shorter than a time required for a length of the carded sliver to be delivered, which length corresponds to a long time variation of the carded sliver thickness and should be periods at which the proper number of pulses are included within the occurrence of the signal *e*1-*a* or *e*1-*b*.

As mentioned hereinbefore, the apparatus of the present invention for controlling the sliver-thickness variation comprises the following: means for detecting the thickness of the sliver delivered from the carding machine and indicating it as an electric signal; means for producing a difference signal by comparing said electric signal corresponding with the thickness of the runing sliver S and the reference voltage level corresponding to the predetermined constant thickness of the sliver S and, thereby, the supply amount of the fiber tufts to the carding machine is controlled at a far shorter period than a time required for a length of the carded sliver to be delivered, which length corresponds to a long term variation of the carded sliver thickness. Therefore, the present invention can provide an apparatus for controlling the sliver-thickness variation in a carding machine, in which apparatus, although it is of extremely simple construction and is manufactured at low cost, differences with respect to a reference value of the thickness of the sliver S become extremely small and, accordngly, the sliver-thickness variation can be eliminated. Further, an initial adjustment of a preset value, which adjustment is required every time the conditions of a production goal, producing speed, etc. change, can easily be completed in a short time, and, in addition, it is easy to maintain the apparatus in good condition.

In the above-mentioned embodiments, the following modifications may also be possible. (1) The detecting means for detecting the thickness of the sliver and producing an electric signal, which detecting means comprises the measuring roller and the potentiometer, can be replaced by a detecting means which comprises the measuring roller and electrodes cooperating with the measuring roller and forming an electrostatic capacity between the electrodes, where the electrostatic capacitance of the capacity varies in accordance with a movement of the measuring roller.

(2) The controlling means for controlling the supply amount of the fiber tufts to the carding machine, which controlling means comprises the pilot motor, the variable speed transmission device the speed conversion ratio of which is changed by the pilot motor and the feed roller driven by way of the variable speed transmission device, can be replaced by a controlling means for a drive controller which directly controls a driving motor of a feed roller, or a controlling means 70 for changing the dimensions of an opening 72 of a chute feeding device 71 through which opening the fiber tufts are supplied.

(3) In the first embodiment, the triangle wave signal, which is superposed on the output signal of the differential amplifier, can be replaced by a saw-tooth wave signal or a sine wave signal.

(4) In the first embodiment, the supply amount of the fiber tufts is intermittently controlled by the pulse signal, the pulse width of which is proportional to the time duration in which the amplitude of the superposed signal is excess of the predetermined reference voltage level, however, said supply amount can also be controlled intermittently by a pulse signal, the number of pulses of which is proportional to the time duration when the amplitude of the superposed signal is higher or lower than the predetermined reference voltage level.

What is claimed is:

1. An apparatus for controlling the sliver-thickness variation in a carding machine, comprising:

a first device for detecting the thickness of the sliver delivered from the carding machine and creating a corresponding electric signal;

a first control circuit for producing a difference signal by comparing said electric signal indicating the thickness of the sliver with a reference level signal indicating a predetermined constant thickness of the sliver;

a second control circuit for creating a control pulse signal in accordance with said difference signal intermittently at time intervals, each of said time intervals being shorter than a time required for a length of carded sliver to be delivered, which length corresponds to a long term variation of sliver thickness, said second control circuit comprising:

a first circuit for superimposing one alternating current periodic signal which has a far shorter period than the long period of sliver-thickness variation during the delivery of the sliver, on said difference signal;

a second circuit which processes said difference signal and produces a control pulse signal, a time-related characteristic of which is proportional to a time interval in which the amplitude of said superimposed signal exceeds a predetermined reference level; and a second device for intermittently adjusting the supply amount of fiber tufts to the carding machine by said control pulse signal at each of said time intervals for reducing said difference signal toward zero, whereby the supply amount of the fiber tufts to the carding machine is intermittently controlled by aid control signal so as to equalize the thickness.

2. An apparatus according to claim 1, wherein said first circuit comprises a circuit for superimposing a triangular wave signal on said difference signal, and said second circuit comprises a circuit for comparing said superimposed signal with a positive reference lever signal and negative reference level signal, wherein said control pulse signal is obtained (i) when the level of said superimposed signal is higher than said positive reference level signal and (ii) when the level of said superimposed signal is lower than said negative reference level signal.

3. An apparatus for controlling the sliver-thickness variation in a carding machine, comprising:

a first device for detecting the thickness of the sliver delivered from the carding machine and creating a corresponding electric signal, said first device comprising means for detecting the thickness of the sliver delivered from the carding machine, means for expanding the amount of the variation of the detected thickness of the sliver, means for filtering out a high frequency variation of the thickness of the sliver from the detected variation of the thickness of the sliver by an expanding mechanism comprising elastic links, levers, spring means and an oil damper, and means for creating a corresponding amplified and filtered electric signal in accordance with the variation of the thickness of the sliver;

a first control circuit for producing a difference signal by comparing said electric signal indicating the thickness of the sliver with a reference level signal indicating a predetermined constant thickness of the sliver;

a second control circuit for creating a control pulse signal in accordance with said difference signal intermittently at time intervals, each of said time intervals being shorter than a time required for a length of carded sliver to be delivered, which length corresponds to a long term variation of sliver thickness; and a second device for intermittently adjusting the supply amount of fiber tufts to the carding machine by said control pusle signal at each of said time intervals for reducing said difference signal toward zero.

4. An apparatus for controlling the sliver-thickness variation in a carding machine, comprising:

a first device for detecting the thickness of the sliver delivered from the carding maching and creating a corresponding electric signal;

a first control circuit for producing a difference signal by comparing said electric signal indicating the thickness of the sliver with a reference level signal indicating a predetermined constant thickness of the sliver;

a second control circuit for creating a control pulse signal in accordance with said difference signal intermittently at time intervals, each of said time intervals being shorter than a time required for a length of carded sliver to be delivered, which length corresponds to a long term variation of sliver thickness, said second control circuit comprising:

a first circuit for superimposing one alternating current periodic signal which has a far shorter period that the long period of sliver-thickness variation during the delivery of the sliver, on said difference signal, said first circuit comprising a circuit for superimposing a triangular wave signal on said difference signal, and a second circuit which processes said difference signal and produces a control pulse signal which is proportional to a time interval in which the amplitude of said superimposed signal exceeds a predetermined reference level, said second circuit comprising a circuit for comparing said superimposed signal with a reference level signal, wherein said control pulse signal is obtained when the level of pulse signal is obtined when the level of said superimposed signal is outside the range defined by said reference level signal, whereby the supply amount of the fiber tufts to the carding machine is intermittently controlled by said control signal so as to equalize the thickness; and a second device for intermittently adjusting the supply amount of fiber tufts to the carding machine by said control pulse signal toward zero.

5. An apparatus according to claim 4 wherein said second circuit of said second control circuit comprises a circuit for producing a control pulse signal having a pulse width corresponding to the difference between said superimposed signal and said positive and negative reference level signals, said control pulse signal adjusting the supply amount of fiber tufts to the carding machine intermittently for reducing said difference signal toward zero.

6. An apparatus for controlling the sliver-thickness variation in a carding machine, comprising:

a first device for detecting the thickness of the sliver delivered from the carding machine and creating a corresponding electric signal, said first device comprising a pair of opposed measuring rollers, one of which is rotated on a fixed shaft, the other of which is rotated in an L-shaped member which is pivotably supported on a fixed shaft, a first connecting level pivotably supported by said L-shaped member at one end, a first level which is pivotably supported on a fixed shaft at one end thereof and is pivotably connected to said first connecting lever and has a spring provided between a fixed point and one portion thereof, a second connecting lever comprising a spring member such as a lead spring, and an L-shaped lever which is pivotably supported on a fixed shaft at a cross portion thereof, one arm of which is pivotably connected to said second connecting lever through a third connecting lever pivotably connected to the other arm of which has a bar connected to an oil damper having a piston with orifices interposed within an oil cylinder and connects to a last lever having a slitlike hole and connecting a variable tap of a fixed potentiometer;

a first control circuit for producing a difference signal by comparing said electric signal indicating the thickness of the sliver with a reference level signal indicating a predetermined constant thickness of the sliver;

a second control circuit for creating a control pulse signal in accordance with said difference signal intermittently at time intervals, each of said time intervals being shorter than a time required for a length of carded sliver to be delivered, which length corresponds to a long term variation of sliver thickness;

a second device for intermittently adjusting the supply amount of fiber tufts to the carding machine by said control pulse signal at each of said time intervals for reducing said difference signal toward zero.

7. An apparatus for controlling the sliver-thickness variation in a carding machine, comprising:

a first device for detecting the thickness of the sliver delivered from the carding machine an creating a corresponding electric signal, said first device comprising a pair of opposed measuring rollers, one of which is rotated on a fixed shaft, the other of which is rotated in an L-shaped member which is pivotably supported on a fixed shaft, a first connecting lever pivotably supported by said L-shaped member at one end, a first lever which is pivotably supported on a fixed shaft at one end thereof and is pivotably connected to said first connecting lever and has a spring provided between a fixed point and one portion thereof, a second connecting lever comprising a spring member such as a leaf spring, and an L-shaped lever which is pivotably supported on a fixed shaft at a cross portion thereof, one arm of which is pivotably connected to said second connecting lever through a third connecting lever pivotably connected to the other arm of which has a bar connected to an oil damper having a piston with orifices interposed within an oil cylinder and connects to a last lever having a slit-like hole and connecting a variable tap of a fixed potentiometer, a first control circuit for producing a difference signal by comparing said electric signal indicating the thickness of the sliver with a reference lever signal indicating a predetermined constant thickness of the sliver, said first control circuit comprising a setting device comprising a potentiometer in which said reference lever signal is set so as to correspond to a predetermined thickness of the sliver and a differential amplifier, connected to said filter circuit and said setting device, which compares said electric signal indicating the thickness of said sliver with said reference level signal and produces a difference signal therebetween;

a second control circuit for creating a control pulse signal in accordance with said difference signal intermittently at time intervals, each of said time intervals being shorter than a time required for a length of carded sliver to be delivered, which length corresponds to a long term variation of sliver thickness, said second control circuit comprising:

a first circuit for superimposing one alternating current periodic signal which has a far shorter period than the long period of sliver-thickness variation during the delivery of the sliver, on said difference signal;

a second circuit which processes said difference signal and produces a control pulse signal, a time-related characteristic of which is proportional to a time interval in which the amplitude of said superimposed signal exceeds a predetermined reference level, whereby the supply smount of the fiber tufts to the carding machine is intermittently controlled by said control signal so as to equalize the thickness, said first circuit of said second control circuit comprises a triangular wave generator which generates a triangular wave signal having a far shorter period than the period of the long term sliver-thickness variation, and an adder circuit, connected to said differential amplifier of said first control and said triangular wave generator, which adder circuit adds said triangular wave signal to said difference signal to produce a superimposed signal, said second circuit of said second control circuit comprises a first level setting device which presets a predetermined positive reference level, a first comparator, connected to said adder circuit of said first circuit and to said first level setting device, which compares a positive part of said superimposed signal with said positive reference level and generates said control signal, a first amplifier, connected to said first comparator, which amplifies said control signal, a first relay, connected to said first amplifier, which operates on and off in response to said amplified control pulse signal, a second level setting device which presets a predetermined negative reference level, a second comparator, connected to said adder circuit of said first circuit and to said first level setting device, which compares a negative part of said superimposed signal with said negative reference level and generates said control pulse signal, a second amplifier, connected to said second comparator, which amplifies said control pulse signal, and a second relay, connected to said second amplifier which operates on and off in response to said amplified control signal, and a second device for intermittently adjusting the supply amount of fiber tufts to the carding machine by said control pulse signal at each of said time intervals for reducing said difference signal toward zero, said second device comprising a pilot motor, connected to said first and second relays, which is rotated in a forward direction by electric power from said first relay or is rotated in a reverse direction by electric power from said second relay, and a transmission device for driving a feed roller the speed conversion ratio of which is controlled by the amount and direction of the rotation of said pilot motor thereby controlling the rotational speed of said feed roller.

8. An apparatus for controlling the sliver-thickness variation in a carding machine, comprising:

a first device for detecting the thickness of the sliver delivered from the carding machine and creating a corresponding electric signal, said first device comprising a pair of opposed measuring rollers, one of which is rotated on a fixed shaft, the other of which is rotated in an L-shaped member which is pivotably supported on a fixed shaft, a first connecting lever pivotably supported by said L-shaped member at one end, a first lever which is pivotably supported on a fixed shaft at one end thereof and is pivotably connected to said first connecting lever and has a spring provided between a fixed point and one portion thereof, a second connecting lever comprising a spring member such as a leaf spring, and an L-shaped lever which is pivotably supported on a fixed shaft at a cross portion thereof, one arm of which is pivotably connected to said second connecting lever through a third connecting lever pivotably connected to the other arm of which has a bar connected to an oil damper having a piston with orifices interposed within an oil cylinder and connects to a last lever having a slit-like hole and connecting a variable tap of a fixed potentiometer;

a first control circuit for producing a difference signal by comparing said electric signal indicating the thickness of the sliver with a reference level signal indicating a predetermined constant thickness of the sliver, said first control circuit comprising a setting device comprising a potentiometer in which said reference level signal is set so as to correspond to a predetermined thickness of the sliver, and a differential amplifier, connected to said filter circuit and said setting device, which compares said electric signal indicating the thickness of said sliver with said reference level signal and produces a difference signal therebetween;

a second control circuit for creating a control pulse signal in accordance with said difference signal intermittently at time intervals, each of said time intervals being shorter than a time required for a length of carded sliver to be delivered, which length corresponds to a long term variation of sliver thickness, said second control circuit comprising a circuit for processing said difference signal and producing a control pulse signal, the pulse width or pulse repetition rate of which is proportional to the variation in the thickness of the sliver, the control pulse signal having an associated interval of time which is far shorter than the time required for a length of the carded sliver to be delivered, which length corresponds to a long term variation of the carded sliver thickness, whereby the supply amount of the fiber tufts to the carding machine is intermittently controlled by said control pulse signal so as to equalize the thickness, said circuit of said second control circuit processing said difference signal and producing a control signal, the pulse width of which is proportional to the variation in the thickness of the sliver and which has an interval of time which is far shorter than the time required for a length of the carded sliver to be delivered, which length corresponds to a long term variation of the carded sliver thickness, said circuit of said second control circuit comprising a first comparator circuit, connected to said first control circuit, which produces a signal when said difference signal is negative, a relay comprising a coil, first and second switching over elements having respectively two output terminals, said coil being connected to said first comparator circuit and said first switching over element being connected to said first control circuit, an inverter circuit an input termninal of which is connected to said second output terminal of said first switching over element of said relay, an oscillator for producing a clock pulse which has a shorter period of time than the period of time of the variation of the carded sliver thickness, a flip-flop circuit, connected to said oscillator and to said second switching over element of said relay, which is set from logic level "0" to logic level "1" in response to said clock pulse signal from said oscillator, an integrator circuit, connected to said flip-flop circuit, which produces an integrated output signal in response to an output signal of said flip-flop circuit, and a second comparator circuit, connected to said first tap of said relay and said inverter circuit and said integrator circuit, which compares said difference signal through said first switching over element of said relay from said first control circuit with said integrated output signal, and an output circuit with said intergrated output signal, and an output terminal which is connected to a reset terminal of said flip-flop circuit and a reset terminal of said integrator circuit, so that said flip-flop circuit produces an output signal through said second switching over element of said relay as said control pulse signal, and a second device for intermittently adjusting the supply amount of fiber tufts to the carding machine by said control pulse signal at each of said time intervals for reducing said difference signal toward zero, said second device comprising a pilot motor, connected to said first and second relays, which is rotated in a forward direction by electric power from said first relay or rotated in a reverse direction by electric power from said second relay, and a transmission device for driving a feed roller the speed conversion ratio of which is controlled by the amount and direction of the rotation of said pilot motor thereby controlling the rotational speed of said feed roller.

9. An apparatus for controlling the sliver-thickness variation in a carding machine, comprising:

a first device for detecting the thickness of sliver delivered from the carding machine and creating a corresponding electric signal, said first device comprising a pair of opposed measuring rollers one of which is rotated on a fixed shaft, the other of which is rotated in an L-shaped member which is pivotably supported by said L-shaped member at one end, a first lever which is pivotably supported on a fixed shaft at one end thereof and is pivotably connected to said first connecting lever and has a spring provided between a fixed point and one portion thereof, a second connecting lever comprising a spring member such as a leaf spring, and an L-shaped lever which is pivotably supported on a fixed shaft at a cross portion thereof, one arm of which is pivotably connected to said second connecting lever through a third connecting lever pivotably connected to the other arm of which has a bar connected to an oil damper having a piston with orifices interposed within an oil cylinder and connects to a last lever having a slit-like hole and connecting a variable tap of a fixed potentiometer;

a first control circuit for producing a difference signal by comparing said electric signal indicating the thickness of the sliver with a reference level signal indicating a predetermined constant thickness of the sliver, said first control circuit comprising a setting device comprising a potentiometer in which said reference level signal is set so as to correspond to a predetermined thickness of the sliver, and a differential amplifier, connected to said filter circuit and said setting device, which compares said electric signal indicating the thickness of said sliver with said reference lever signal and produces a difference signal therebetween;

a second control circuit for creating a control pulse signal in accordance with said difference signal intermittently at time intervals, each of said time intervals being shorter than a time required for a length of carded sliver to be delivered, which length corresponds to a long term variation of sliver thickness, said second control comprising a circuit for processing said difference signal and producing a control pulse signal, the pulse width or pulse repetition rate of which is proportional to the variation in the thickness of the sliver, the control pulse signal having an associated interval of time which is far shorter than the time required for a length of the carded sliver to be delivered, which length corresponds to a long term variation of the carded sliver thickness, whereby the supply amount of the fiber tufts to the carding machine is intermittently controlled by said control pulse signal so as to equalize the thickness, said circuit of said second control circuit comprising a first diode the anode of which is connected to said first control circuit, a first voltage/frequency converter, connected to a cathode of said first diode and which produces a signal having a frequency in response to the magnitude of said difference signal, a first monostable multivibrator which is connected to said voltage/frequency converter and which produces a number of pulses having a predetermined pulse width as said control pulse signal, the number of which is proportional to the frequency of said signal from said first voltage/frequency converter, an inverter circuit connected to said first control circuit and which inverts a negative difference signal to a positive difference signal, a second diode the anode of which is connected to said inverter circuit, a second voltage/frequency converter connnected to a cathode of said second diode and which produces a signal having a frequency in response to the magnitude of said inverted difference signal, and a second monostable multivibrator connected to said voltage/ frequency converter and which produces a number of pulses having a predetermined pulse width as said control pulse signal, the number of which is proportional to the frequency of said signal from said second voltage/frequency converter, and a second device for intermittently adjusting the supply amount of fiber tufts to the carding machine by said control pulse signal at each of said time intervals for reducing said difference signal toward zero, said second device comprising a pilot motor connected to said first and second relays and which is rotated in a forward direction by electric power from said first relay or rotated in a reverse direction by electric power from said second relay, and a transmission device for driving a feed roller, the speed conversion ratio of which is controlled by the amount and direction of the rotation of said pilot motor thereby conrtrolling the rotational speed of said feed roller.

10. An apparatus for controlling the sliver-thickness variation in a carding machine, comprising:

a first device for detecting the thickness of the sliver delivered from the carding machine and creating a corresponding electric signal;

a first control circuit for producing a difference signal by comparing said electric signal indicating the thickness of the sliver with a reference level signal indicating a predetermined constant thickness of the sliver;

a second control circuit for creating a control pulse signal in accordance with said difference signal intermittently at time intervals, each of said time intervals being shorter than a time required for a length of carded sliver to be delivered, which length corresponds to a long term variation of sliver thickness; and a second device for intermittently adjusting the supply amount of fiber tufts to the carding machine by said control pulse signal at each of said time intervals for reducing said difference signal toward zero, said second device comprising first and second relays, a pilot motor connected to said relays which is rotated in a forward direction by electric power from said first relay and is rotated in a reverse direction by electric power from said second relay, and a transmission device for driving a feed roller the speed conversion ratio of which is controlled by the amount and direction of rotation of said pilot motor, thereby controlling the rotational speed of said feed roller.

11. An apparatus according to claim 10, wherein said second device comprises a device for directly controlling the pilot motor which drives said feed roller, and a device for changing the dimensions of an opening of a chute feeding device through which opening fiber tufts are supplied.

12. A method for controlling the sliver-thickness variation in a carding machine, comprising the steps of:

detecting the thickness of the sliver delivered from the carding machine and creating a corresponding electric signal;

producing a difference signal by comparing said electric signal indicating the thickness of the sliver to a reference level signal indicating a predetermined constant thickness of the sliver;

creating a control pulse signal having a time-dependent pulse characteristic corresponding to the value of said difference signal intermittently at time intervals, each of said time intervals being shorter than a time required for a length of carded sliver to be delivered, which length corrresponds to a long term variation of said carded sliver thickness, said control pulse signal creating step comprising the steps of:

superimposing one alternating current periodic signal which has a far shorter period than the long period of the sliver-thickness variation during the delivery of the sliver, on said difference signal;

processing said difference signal to produce a control pulse signal, a time-dependent pulse characteristic of which is porportional to a time period in which the amplitude of said superimposed signal exceeds a predetermined reference level; and adjusting the supply amount of fiber tufts to the carding machine intermittently by said control pulse signal at each of said time intervals for reducing said difference signal toward zero, whereby the supply amount of the fiber tufts to the carding machine is intermittently controlled by said control pulse signal so as to equalize the thickness.

* * * * *

UNITED STATES PATENT OFFICE

CERTIFICATE OF CORRECTION

Patent No. 4,099,297 Dated July 11, 1978

Inventor(s) Junzo Hasegawa, et al

It is certified that error appears in the above-identified patent and that said Letters Patent are hereby corrected as shown below:

In the Drawings, in Fig. 3: Change the labeling of block 30a from "REFERENCE" to -- + REFERENCE --;

Change the labeling of block 30b from "REFERENCE" to -- - REFERENCE --.

Column 4, line 53 & 57: Change "deviation" to --difference--.

Column 10, line 55: "element" should be --switching over element--.

Column 11, line 63: "switches" should be --switching over elements--.

Column 13, line 6: "comprises-" should be --comprises:--.

Column 14, line 28: "runing" should be --running--.

Column 16, line 29: "pusle" should be --pulse--.

line 35: "maching" should be --machine--.

lines 65 & 66: Cancel "pulse signal is obtined when the level of".

UNITED STATES PATENT OFFICE

CERTIFICATE OF CORRECTION

Patent No. 4,099,297 Dated July 11, 1978

Inventor(s) Junzo Hasegawa, et al

It is certified that error appears in the above-identified patent and that said Letters Patent are hereby corrected as shown below:

Column 17, line 6: After "signal" insert --at each of said time intervals for reducing said difference signal--.

line 62: "an" should be --and--.

Column 18, line 49: "smount" should be --amount--.

Column 22, line 38: "conrtrolling" should be --controlling--.

Signed and Sealed this

*Eighteenth* Day of *September 1979*

[SEAL]

*Attest:*

*Attesting Officer*

LUTRELLE F. PARKER

*Acting Commissioner of Patents and Trademarks*